US005859916A

United States Patent [19]

Ball et al.

[11] Patent Number: 5,859,916

[45] Date of Patent: Jan. 12, 1999

[54] TWO STAGE IMPLANTABLE MICROPHONE

[75] Inventors: Geoffrey R. Ball, Sunnyvale; Wyndham Robertson, III, Fremont; Christopher A. Julian, Los Gatos, all of Calif.

[73] Assignee: Symphonix Devices, Inc., San Jose, Calif.

[21] Appl. No.: 680,578

[22] Filed: Jul. 12, 1996

[51] Int. Cl.[6] ..... H04R 25/00

[52] U.S. Cl. ..... 381/326; 600/25; 600/57

[58] Field of Search ..... 600/25, 56; 607/57; 381/68.3, 202, 23.1, 312, 313, 317, 318, 326

[56] References Cited

U.S. PATENT DOCUMENTS

| | | | |
|---|---|---|---|
| 2,702,354 | 2/1955 | Chorpening . | |
| 3,736,436 | 5/1973 | Crites | 307/88 |
| 4,281,222 | 7/1981 | Nakagawa et al. | 381/155 |
| 4,524,247 | 6/1985 | Lindenberger et al. | 179/111 |
| 4,591,668 | 5/1986 | Iwata | 179/121 |
| 4,597,099 | 6/1986 | Sawafuji | 381/90 |
| 5,085,628 | 2/1992 | Engebretson et al. | 600/25 |
| 5,146,435 | 9/1992 | Bernstein | 381/181 |
| 5,148,492 | 9/1992 | Uzawa et al. | 381/202 |
| 5,303,210 | 4/1994 | Bernstein | 381/174 |
| 5,329,593 | 7/1994 | Lazzeroni | 381/168 |
| 5,452,268 | 9/1995 | Bernstein | 381/181 |
| 5,624,376 | 4/1997 | Ball et al. | 381/68 |
| 5,624,377 | 4/1997 | Davis | 600/25 |

FOREIGN PATENT DOCUMENTS

| | | | |
|---|---|---|---|
| 0133125 | 10/1979 | Japan | 381/202 |
| 0038098 | 3/1983 | Japan | 381/202 |
| 6-225385 | 8/1994 | Japan | 381/202 |

OTHER PUBLICATIONS

Deddens, M.D. et al., "Totally Implantable Hearing Aids: The Effects of Skin Thickness on Microphone Function," Original Contributions, 1990, pp. 1–4.

Ohno, "The Implantable Hearing Aid," Audecibel, 1984, pp. 28–30.

Rion Co., Ltd., "Middle Ear Implant Information," 4 pages.

Scheeper, et al., "Improvement of the performance of microphones with a silicon nitride diaphragm and backplate," Sensors and Actuators, A., 40, 1994, pp. 179–186.

Schellin, et al., "Corona–poled piezoelectric polymer layers of P(VDF/TrFE) for micromachined silicon microphones," J. Micromach Microeng 5, 1995, pp. 106–108.

Suzuki[a], "Early Studies and the History of Development of the Middle Ear Implant in Japan," Adv. Audiol., vol. 4, 1988, pp. 1–14.

Yanagihara, M.D., et al., "Development of an implantable hearing aid using a piezoelectric vibrator of bimorph design: State of the art," Otolaryngology–Head and Neck Surgery, vol. 92, No. 6, 1984, pp. 706–712.

*Primary Examiner*—Curtis A. Kuntz
*Assistant Examiner*—Rexford N. Barnie
*Attorney, Agent, or Firm*—Townsend and Townsend and Crew LLP

[57] ABSTRACT

Two stage implantable microphone devices suitable for use in hearing systems are provided. An implantable microphone device may include a housing including a diaphragm with the housing and diaphragm enclosing a chamber; a microphone coupled to the housing; and a vent connecting the microphone to the chamber. Vibrations of the diaphragm are transmitted through the chamber as a first stage and through the vent as a second stage to the microphone. The relative dimensions of the chamber and vent may be utilized to tune the frequency response and sensitivity of the device.

12 Claims, 4 Drawing Sheets

TWO STAGE IMPLANTABLE MICROPHONE

BACKGROUND OF THE INVENTION

The present invention is related to hearing systems and, more particularly, to two stage implantable microphone devices that may be utilized in hearing systems.

Conventional hearing aids are placed in the ear canal. However, these external devices have many inherent problems including the blockage of the normal avenue for hearing, discomfort because of the tight seal required to reduce the squeal from acoustic feedback and the all-too-common reluctance for hearing-impaired persons to wear a device that is visible.

Recent advances in miniaturization have resulted in hearing aids that are able to be placed deeper in the ear canal such that they are almost unnoticeable. However, smaller hearing aids bring with them new problems including troublesome handling and more difficult care.

Implantable hearing devices offer the hope of eliminating problems associated with conventional hearing aids. One requirement for an implantable hearing device or system is an implantable microphone. Prior art implantable microphones for use with hearing systems have comprised an electret microphone encased in a metal housing.

With the advent of implantable direct-drive devices for stimulating hearing, there is a great need for implantable microphones that provide excellent audio characteristics. Such implantable microphones may open the doors to a new era where implantable hearing devices replace the conventional hearing aid.

SUMMARY OF THE INVENTION

The present invention provides two stage implantable microphone devices that may be utilized in hearing systems. An implantable microphone device of the present invention has stages that allow the implantable microphone's frequency response and sensitivity to be selected. The implantable microphone provides excellent audio characteristics and is very thin, making it very suitable for implantation.

In one embodiment, the present invention provides an implantable microphone device, comprising: a housing including a diaphragm, the housing and diaphragm enclosing a chamber; a microphone coupled to the housing; and a vent connecting the microphone to the chamber so that vibrations of the diaphragm are transmitted through the chamber and vent to the microphone. Preferably, the microphone is an electret microphone.

In another embodiment, the present invention provides an implantable microphone device, comprising: a housing including a diaphragm, the housing and diaphragm enclosing a chamber; an acoustic resistor between the diaphragm and an opposing surface of the housing; a microphone coupled to the housing; and a vent connecting the microphone to the chamber so that vibrations of the diaphragm are transmitted through the chamber and vent to the microphone.

In another embodiment, the present invention provides an implantable microphone device, comprising: a housing including a diaphragm, the housing and diaphragm enclosing a chamber; a microphone coupled to the housing; and a vent connecting the microphone to the chamber so that vibrations of the diaphragm are transmitted through the chamber and vent to a surface of the microphone, wherein the surface of the microphone that receives the vibrations is substantially perpendicular to the diaphragm.

In another embodiment, the present invention provides an implantable microphone device, comprising: a housing including a diaphragm having a plurality of bellows, the housing and diaphragm enclosing a chamber; an acoustic resistor between the diaphragm and an opposing surface of the housing; a microphone coupled to the housing; and a vent connecting the microphone to the chamber so that vibrations of the diaphragm are transmitted through the chamber and vent to the microphone.

Other features and advantages of the present invention will become apparent upon a perusal of the remaining portions of the specification and drawings.

DETAILED DESCRIPTION OF PREFERRED EMBODIMENTS

In the description that follows, the present invention will be described in reference to hearing systems. The present invention, however, is not limited to any use or configuration. Therefore, the description the embodiments that follow is for purposes of illustration and not limitation.

Figure 1:
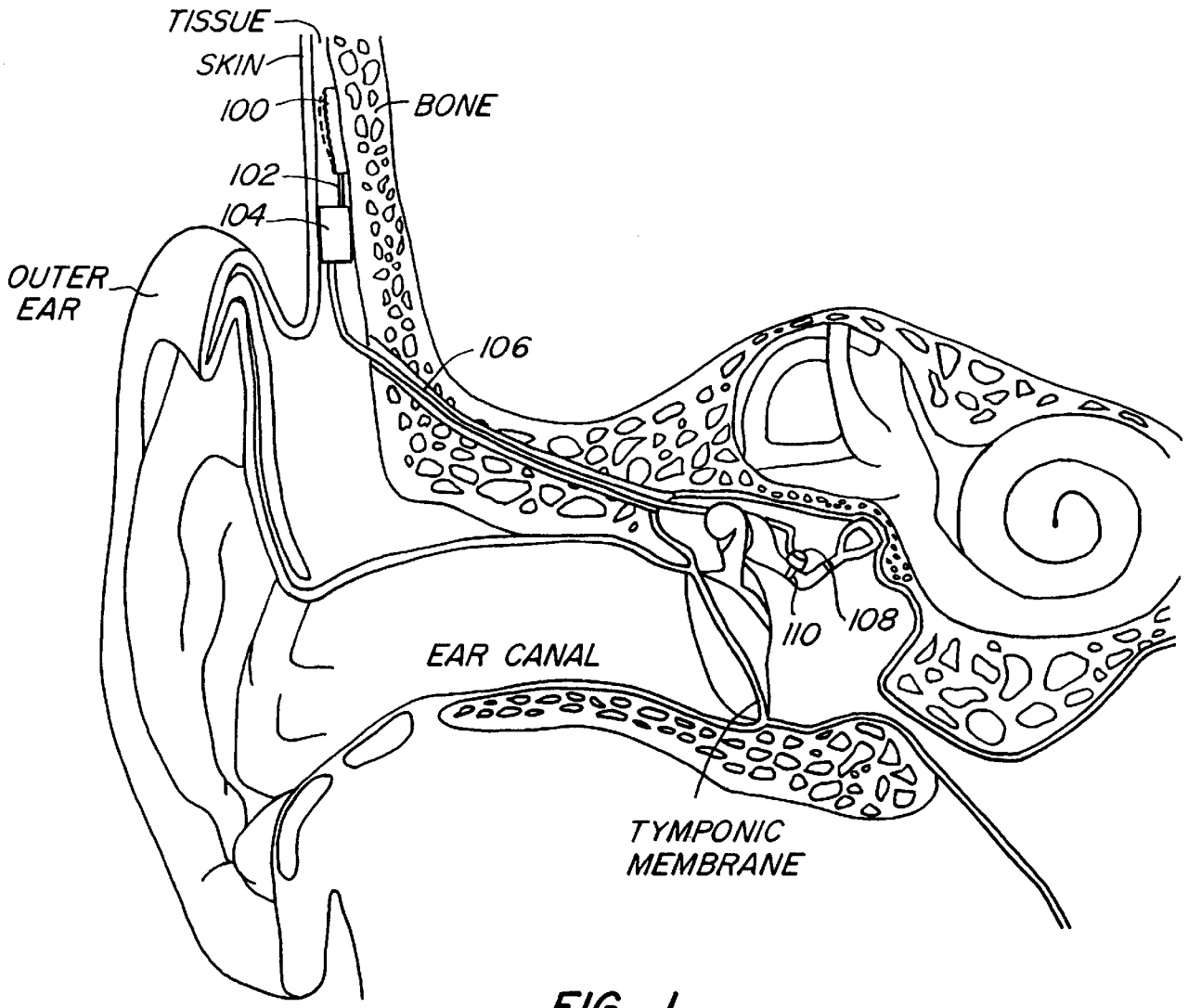
FIG. 1 illustrates an embodiment of the present invention in a hearing system.

FIG. 1 illustrates an embodiment of the present invention in a hearing system. An implantable microphone 100 is located under the skin and tissue behind the outer ear or concha. The implantable microphone picks up sounds through the skin and tissue. The sounds are then translated into electrical signals and carried by leads 102 to an audio processor 104 which may also be located under skin and tissue.

Audio processor receives the electrical signals from the implantable microphone and processes the electrical signals appropriate for the hearing system and individual. An exemplary audio processor may include a battery and signal processing circuitry on an integrated circuit. For example, the audio processor may amplify certain frequencies in order to compensate for the hearing loss of the hearing-impaired person and/or to compensate for characteristics of the hearing system.

Electrical signals from the audio processor travel via leads 106 to a direct-drive hearing device 108. The leads may pass through a channel in the bone as shown or may run under the skin in the ear canal (not shown). In a preferred embodiment, the direct-drive hearing device is a Floating Mass Transducer (FMT) described in U.S. application Ser. No. 08/582,301, filed Jan. 3, 1996 by Geoffrey R. Ball et al., which is hereby incorporated by reference for all purposes.

The direct-drive hearing device vibrates in response to the electric signals and transfers the vibration to the malleus by direct attachment utilizing a clip 110. Although the direct-drive hearing device is shown attached to an ossicle, device 108 may be attached to any structure that allows vibrations to be generated in the inner ear. For example, the direct-drive hearing device may be attached to the tympanic membrane, ossicles, oval and round windows, skull, and within the inner ear. However, if the implantable microphone and direct-drive device are both anchored to bone of the skull, it may be advantageous isolate one of the devices to prevent feedback.

Figure 2:
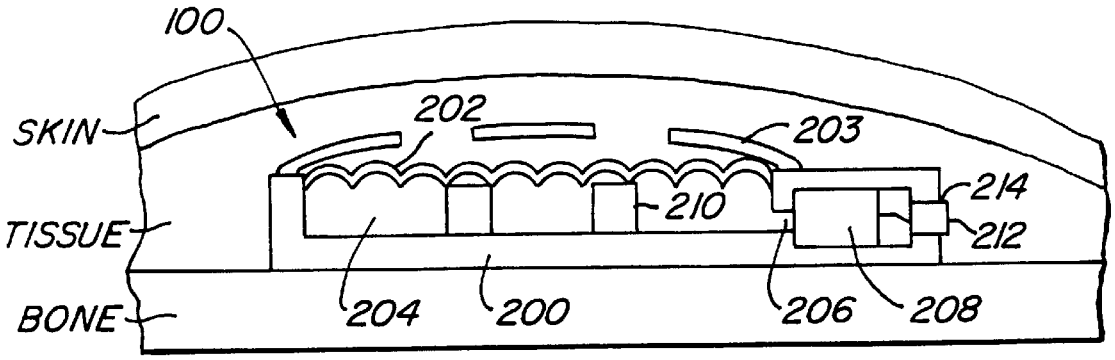
FIG. 2 shows a cross-sectional view of a two stage implantable microphone.

FIG. 2 shows a cross-sectional view of a two stage implantable microphone. As shown, implantable microphone 100 is located under the skin and within the underlying tissue. In a preferred embodiment, the implantable microphone is placed against bone of the skull and may be attached to the bone (e.g., surgical screws). A shock absorbent material may be placed between the implantable microphone and the bone of the skull for vibration isolation. The shock absorbent material may include silicone or polyurethane.

The implantable microphone includes a housing 200 and a diaphragm 202. The diaphragm should be somewhat flexible as it receives sounds transmitted through the skin and tissue. In a preferred embodiment, the diaphragm and housing both include titanium and are laser welded together. In other embodiments, the housing may include ceramic and the diaphragm may include gold, platinum or stainless steel. In order to aid flexibility of the diaphragm, the diaphragm may include bellows or ridges as shown.

The implantable microphone includes a protective cover 203. The protective cover protects the implantable microphone (and diaphragm) from damage when a user's head is struck with an object as sometimes happens in contact sports. The protective cover includes inlet ports which allow sounds to travel to the diaphragm. The protective cover may include a number of materials including titanium and ceramic.

The housing and the diaphragm enclose a chamber 204. The chamber includes a gas, e.g., oxygen, argon, helium, nitrogen, and the like. A vent 206 is connected to the chamber and allows vibrations of the diaphragm to be transmitted through the chamber and vent as sound waves to a microphone 208. In a preferred embodiment, the microphone is an electret condenser microphone that is available from Knowles Electronics, located in Itasca, Ill.

The chamber and vent form two stages through which sounds pass from the diaphragm to the microphone. In order to maximize the surface area of diaphragm yet keep the implantable microphone thin, the chamber is defined or enclosed by the diaphragm and an opposing side of the housing. This allows the implantable microphone be extremely sensitive while being very thin which is advantages for any implantable device. As a result of this arrangement, the surface of the microphone that receives the sound waves or vibrations is substantially perpendicular to the diaphragm.

The frequency response and sensitivity of the implantable microphone may be controlled by the selection of the relative chamber and vent volumes, among other factors like selection of the microphone. The sealed chamber may set up standing resonance and interference patterns leading to a "sea shell effect." Accordingly, an acoustic resistor 210 may be placed within the chamber between the diaphragm and the opposing side of the housing. The acoustic resistor may include any resilient material. For example, the acoustic resistor may include anti-static open cell foam or porous foam rubber.

The sound waves passing through the chamber and vent generate vibrations on a surface of microphone 208. The microphone transforms these vibrations into electrical signals (i.e., is a transducer). Leads 212 from the microphone pass through a plate 214. The plate, along with the diaphragm/housing junctions, preferably hermetically seal the implantable microphone.

Figure 3:
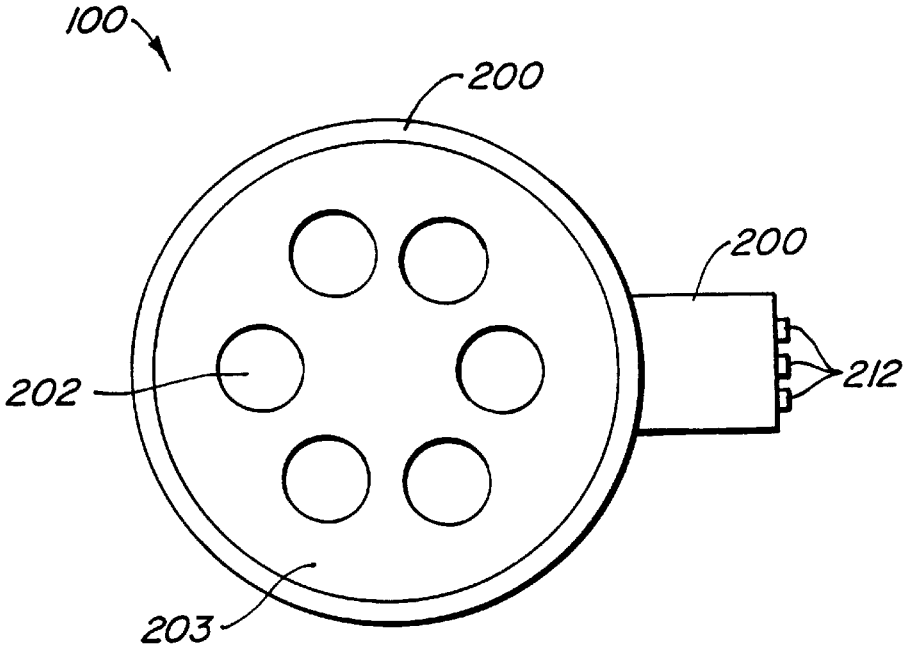
FIG. 3 shows a top view of a two stage implantable microphone.

FIG. 3 shows a top view of a two stage implantable microphone. As shown, protective cover 203 (and therefore the underlying diaphragm) is the majority of the top surface area of the implantable microphone. There are six inlet ports through which sound may travel to the underlying diaphragm 202. At the end of housing 200 are leads 212 that provide electrical signals from the internal microphone.

Figure 4:
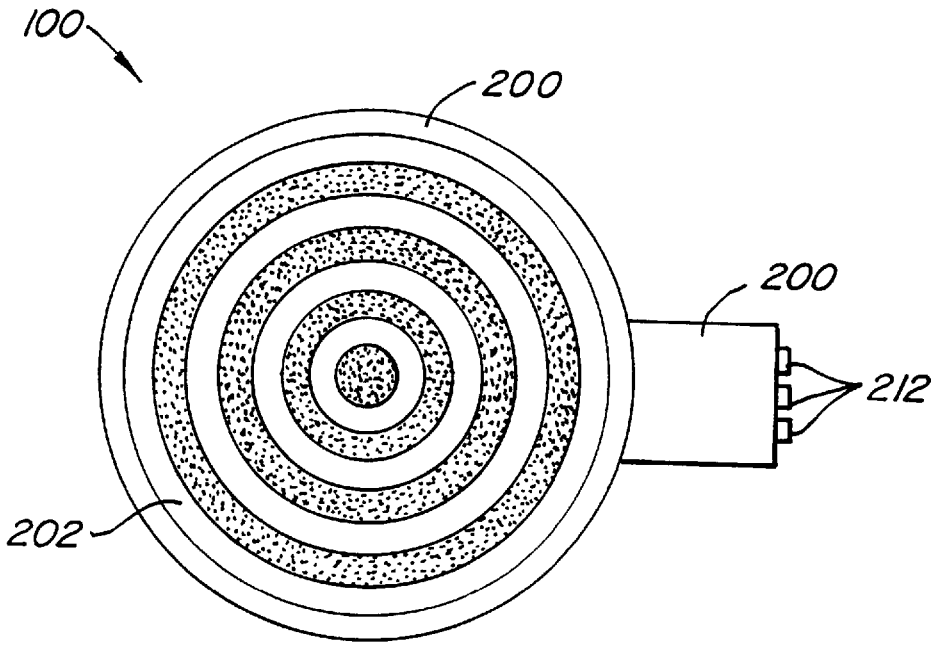
FIG. 4 shows a top view of a two stage implantable microphone without the protective cover.

FIG. 4 shows a top view of a two stage implantable microphone without the protective cover. The differential shading of the diaphragm illustrates the bellows in the diaphragm.

Figure 5:
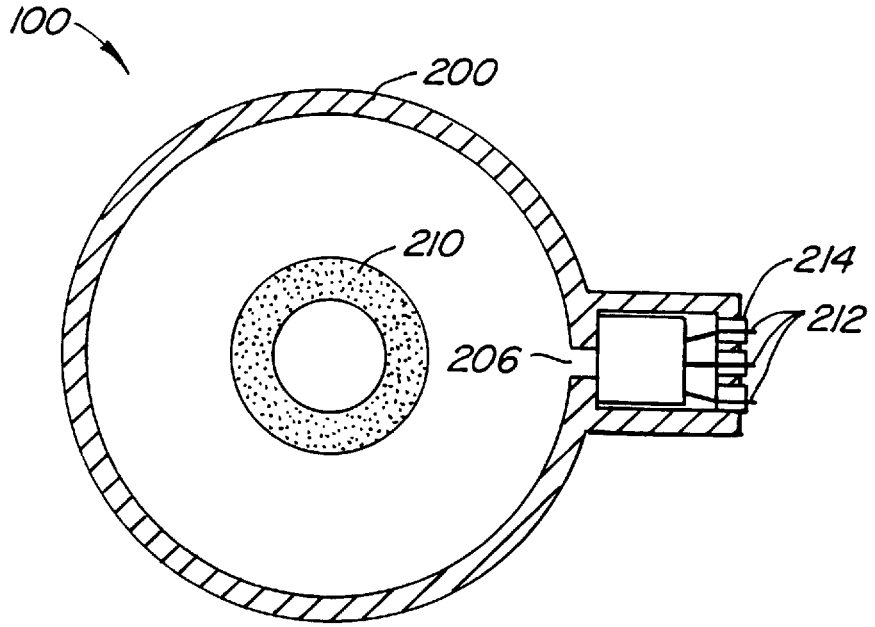
FIG. 5 shows a cross-sectional view of a two stage implantable microphone transverse to the view of FIG. 2.

FIG. 5 shows a cross-sectional view of a two stage implantable microphone transverse to the view of FIG. 2. Within housing 200 is acoustic resistor 210. As shown, the acoustic resistor may be tubular in shape. Additionally, there are three plates 214 that allow three leads 212 to pass from the microphone within the housing to the exterior. The plates are brazened to hermetically seal the implantable microphone. The leads carry electrical signals that correspond to the bending and flexing of the diaphragm in response to sounds.

Figure 6A:
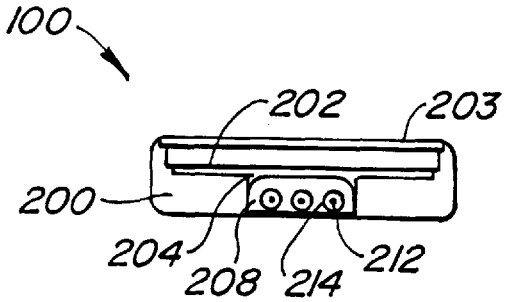
FIGS. 6A–6C show another embodiment of two stage implantable microphone.
Figure 6B:
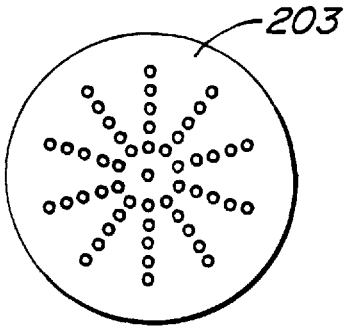
Figure 6C:
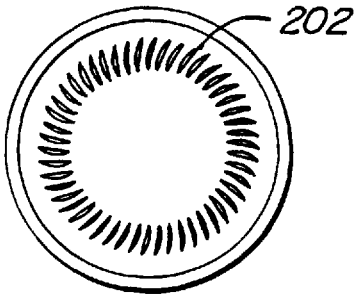

FIGS. 6A–6C show another embodiment of two stage implantable microphone. The same reference numerals will be utilized to indicate structures corresponding to similar structures in previous embodiments. In FIG. 6A, implantable microphone 100 includes a diaphragm 202, a protective cover 203 and a microphone 208. As shown, the surface of the microphone that receives the sound waves or vibrations is substantially parallel to the diaphragm.

FIG. 6B shows the protective cover which has inlet ports that have been chemically etched through the metallic protective cover. In a preferred embodiment, the protective cover is chemically etched titanium.

FIG. 6C shows the diaphragm which has indentations chemically etched into the diaphragm. The indentations are etched partially through (e.g., halfway) the diaphragm in order to increase the flexibility of the diaphragm. In a preferred embodiment, the protective cover is chemically etched titanium.

Embodiments of the present invention have been tested in a variety of ways and have been found to provide excellent sound quality. Initially, an embodiment of the implantable microphone was tested in open air utilizing a Fonix 6500 tester. The open air test was performed to generate a baseline for test patterns of various frequencies.

The implantable microphone was then tested in a saline bath utilizing the Fonix tester. The saline bath is a simulation of placement within a mostly saline body cavity. The depth within the saline bath was set at 10 mm.

The implantable microphone was also tested within tissue from a pig cadaver utilizing the Fonix tester. The implantable microphone was placed within a pocket in the pig tissue at a depth of 10 mm. The pig tissue was immersed in a saline bath to simulate soft tissue.

Comparisons of the output from the implantable microphone from the saline bath and pig tissue to the baseline open air test indicated the implantable microphone possessed good linearity and frequency response. Additionally, speech and music was played so that listeners could subjectively evaluate the implantable microphone in these three environments which confirmed that the implantable microphone provided excellent audio characteristics.

While the above is a complete description of preferred embodiments of the invention, various alternatives, modifications and equivalents may be used. It should be evident that the present invention is equally applicable by making appropriate modifications to the embodiments described above. For example, the above has shown that the implantable microphone and audio processor are separate; however, these two devices may be integrated into one device. Therefore, the above description should not be taken as limiting the scope of the invention which is defined by the metes and bounds of the appended claims along with their full scope of equivalents.

What is claimed is:

1. An implantable microphone device, comprising:

a housing including a diaphragm, the housing and diaphragm enclosing a sealed chamber;

an acoustic resistor between the diaphragm and an opposing surface of the housing;

a microphone coupled to the housing; and a vent connecting the microphone to the chamber so that vibrations of the diaphragm are transmitted through the chamber and vent to the microphone.

2. The device of claim 1, wherein the vent is transverse to the diaphragm.

3. The device of claim 1, wherein the diaphragm is continuous and without perforations and has a plurality of bellows.

4. The device of claim 1, further comprising a protective cover over the diaphragm.

5. The device of claim 1, wherein the housing and diaphragm are composed of titanium.

6. An implantable microphone device, comprising:

a housing including a diaphragm, the diaphragm being continuous and without perforations and having a plurality of bellows, the housing and diaphragm enclosing a chamber;

an acoustic resistor between the diaphragm and an opposing surface of the housing;

a microphone coupled to the housing; and a vent connecting the microphone to the chamber so that vibrations of the diaphragm are transmitted through the chamber and vent to the microphone.

7. The device of claim 6, wherein the vent is transverse to the diaphragm.

8. The device of claim 6, further comprising a protective cover over the diaphragm.

9. The device of claim 6, wherein the housing and diaphragm are composed of titanium.

10. The device of claim 1, wherein the diaphragm has indentations.

11. The device of claim 4, wherein the protective cover over the diaphragm is a perforated cover.

12. The device of claim 8, wherein the protective cover over the diaphragm is a perforated cover.

* * * * *